US009376849B2

(12) United States Patent
Lim

(10) Patent No.: US 9,376,849 B2
(45) Date of Patent: Jun. 28, 2016

(54) DOOR OR WINDOW ASSEMBLY

(71) Applicant: Pd Door Pte Ltd, Singapore (SG)

(72) Inventor: Choo Siong Lim, Singapore (SG)

(73) Assignee: PD Door Pte Ltd, Singapore (SG)

( * ) Notice: Subject to any disclaimer, the term of this patent is extended or adjusted under 35 U.S.C. 154(b) by 0 days.

(21) Appl. No.: 14/771,133

(22) PCT Filed: Feb. 28, 2013

(86) PCT No.: PCT/SG2013/000082

§ 371 (c)(1),
(2) Date: Aug. 27, 2015

(87) PCT Pub. No.: WO2014/133452

PCT Pub. Date: Sep. 4, 2014

(65) Prior Publication Data

US 2016/0010377 A1 Jan. 14, 2016

(51) Int. Cl.

| | |
|---|---|
| ***E05D 15/58*** | (2006.01) |
| ***E05D 15/26*** | (2006.01) |
| ***E06B 3/48*** | (2006.01) |
| ***E06B 3/50*** | (2006.01) |
| ***E05D 15/06*** | (2006.01) |
| ***E05D 15/48*** | (2006.01) |

(52) U.S. Cl.

CPC ..... *E05D 15/266* (2013.01); *E05D 15/0608* (2013.01); *E05D 15/48* (2013.01); *E06B 3/481* (2013.01); *E06B 3/50* (2013.01); *E06B 3/5081* (2013.01); *E05D 2015/485* (2013.01)

(58) Field of Classification Search

CPC ... E05D 15/266; E05D 15/0608; E05D 15/48; E05D 2015/485; E06B 3/50; E06B 3/481; E06B 3/5081

See application file for complete search history.

(56) References Cited

U.S. PATENT DOCUMENTS

| | | | | |
|---|---|---|---|---|
| 4,619,074 | A * | 10/1986 | Leung | E05D 15/58 49/125 |
| 6,170,195 | B1 * | 1/2001 | Lim | E05D 15/58 49/141 |
| 6,422,287 | B1 * | 7/2002 | Wilke | E05D 15/58 160/195 |
| 7,451,802 | B2 * | 11/2008 | Cianciolo | E05D 15/08 160/210 |
| 7,950,439 | B2 * | 5/2011 | Anderson | E05D 15/58 160/195 |
| 2012/0073205 | A1 | 3/2012 | Hamaker et al. | |

FOREIGN PATENT DOCUMENTS

| | | | |
|---|---|---|---|
| JP | H0251679 | U | 4/1990 |
| WO | 2014133452 | A1 | 9/2014 |

OTHER PUBLICATIONS

Foreign Communication From a Related Counterpart Application, International Search Report and Written Opinion dated Jul. 17, 2013, International Application No. PCT/SG13/00082 filed on Feb. 28, 2013.

Foreign Communication From a Related Counterpart Application, International Preliminary Report on Patentability dated Apr. 8, 2015, International Application No. PCT/SG13/00082 filed on Feb. 28, 2013.

* cited by examiner

*Primary Examiner* — Blair M Johnson

(57) ABSTRACT

A door or window assembly (10) is provided. The door or window assembly (10) includes: a track assembly (12); a first leaf (14) slidable along the track assembly (12) in a plane of the first leaf (14) between a first position and a second position; a second leaf (16) moveably coupled to the track assembly (12); and a third leaf (20) pivotally coupled to the second leaf (16). The first leaf (14) is arranged to engage the second leaf (16) to form a combined leaf (86) when the first leaf (14) is in the second position and the combined leaf (86) is arranged to be foldable against the third leaf (20).

16 Claims, 8 Drawing Sheets

DOOR OR WINDOW ASSEMBLY

CROSS-REFERENCE TO RELATED APPLICATIONS

This application is a national stage under U.S.C. 371 of International Application No. PCT/SG2013/000082 filed with the Intellectual Property Office of Singapore on Feb. 28, 2013 and entitled "A DOOR OR WINDOW ASSEMBLY," which is incorporated herein by reference in its entirety for all purposes.

FIELD OF THE INVENTION

The present invention relates, in general, to door and window systems and more particularly to a door or window assembly.

BACKGROUND OF THE INVENTION

Doors and windows are typically used for one or more of the following purposes: to open and close an entrance or opening, to separate an area, to restrict access and to provide visual privacy.

In order for a door or window to perform its intended functions effectively, it is desirable that the door or window be easily operable and fully openable. It is also desirable that the door or window takes up a small footprint, especially when installed in an area with space constraints.

SUMMARY OF THE INVENTION

Accordingly, in a first aspect, the present invention provides a door or window assembly including: a track assembly; a first leaf slidable along the track assembly in a plane of the first leaf between a first position and a second position; a second leaf moveably coupled to the track assembly; and a third leaf pivotally coupled to the second leaf. The first leaf is arranged to engage the second leaf to form a combined leaf when the first leaf is in the second position and the combined leaf is arranged to be foldable against the third leaf.

Other aspects and advantages of the invention will become apparent from the following detailed description, taken in conjunction with the accompanying drawings, illustrating by way of example the principles of the invention.

BRIEF DESCRIPTION OF THE DRAWINGS

An embodiment of the invention will now be described, by way of example only, with reference to the accompanying drawings, in which.

DETAILED DESCRIPTION OF AN EXEMPLARY EMBODIMENT

The detailed description set forth below in connection with the appended drawings is intended as a description of a presently preferred embodiment of the invention, and is not intended to represent the only form in which the present invention may be practiced. It is to be understood that the same or equivalent functions may be accomplished by different embodiments that are intended to be encompassed within the scope of the invention.

Figure 1:
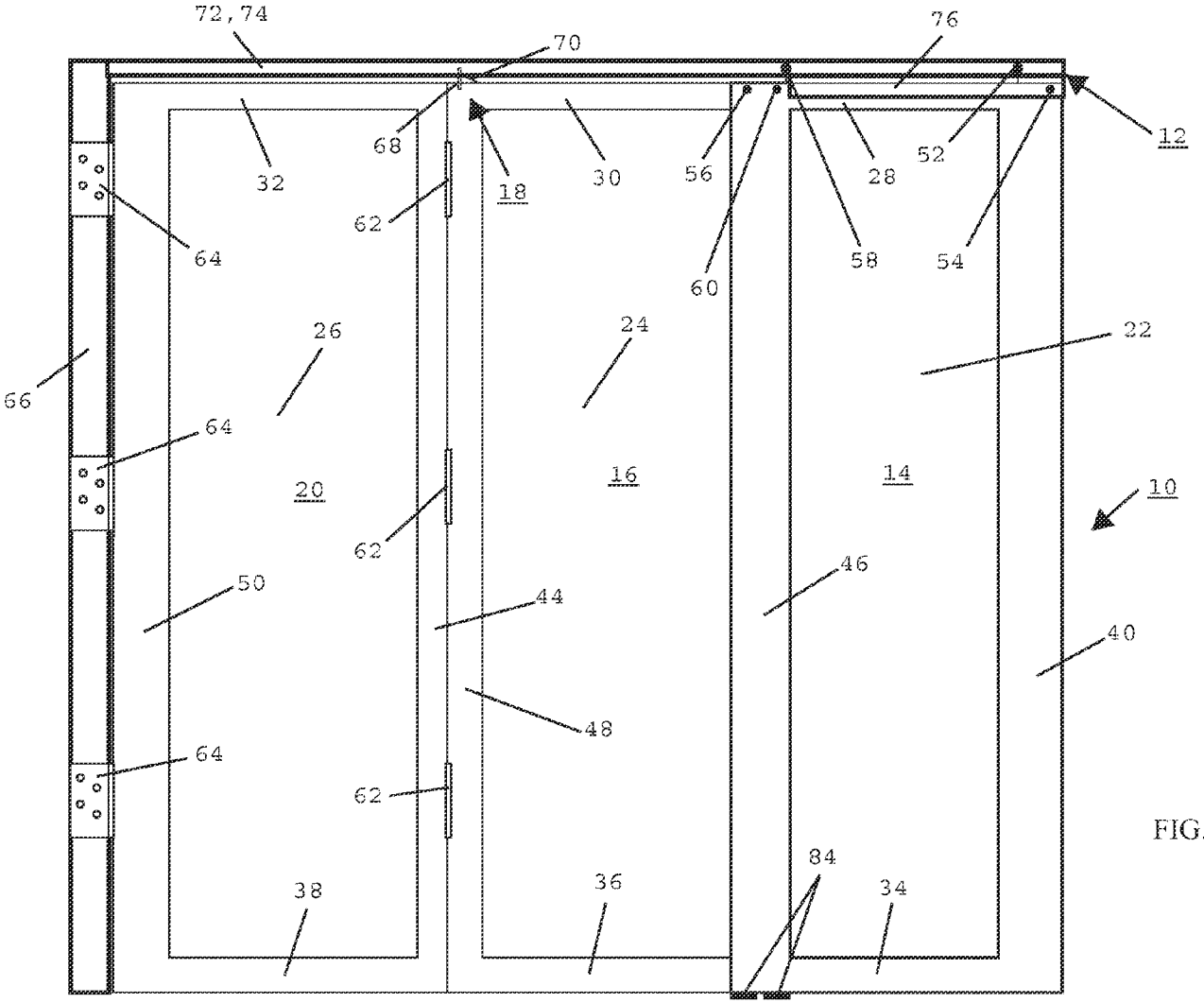
FIG. 1 is a schematic view of a door or window assembly in accordance with an embodiment of the present invention.

Referring now to FIG. 1, a door or window assembly 10 is shown. The door or window assembly 10 includes a track assembly 12, a first leaf 14 slidable along the track assembly 12 in a plane of the first leaf 14, a second leaf 16 moveably coupled to the track assembly 12, a locking mechanism 18 operable to lock the second leaf 16 in a stationary position relative to the track assembly 12 and a third leaf 20 pivotally coupled to the second leaf 16.

Each of the first, second and third leafs 14, 16 and 20 includes a panel 22, 24 and 26 surrounded by a top rail 28, 30 and 32 at respective top edges of the panels 22, 24 and 26, a bottom rail 34, 36 and 38 at respective bottom edges of the panels 22, 24 and 26, a first stile 40, 42 (shown, for example, in FIG. 2) and 44 at respective first or distal edges of the panels 22, 24 and 26 and a second stile 46, 48 and 50 at respective second or proximal edges of the panels 22, 24 and 26. The proximal and distal edges of each leaf 14, 16 and 20 are defined relative to the point of attachment of the door or window assembly 10.

A first rotatable roller 52, a first roller 54 and a second roller 56 are coupled to the top rail 28 of the first leaf 14 and a second rotatable roller 58 and a third roller 60 are coupled to the top rail 30 of the second leaf 16.

A first hinge 62 pivotally couples the second leaf 16 to the third leaf 20. In the embodiment shown, three (3) first hinges 62 are used to couple the second leaf 16 to the third leaf 20. However, it should be understood by those of ordinary skill in the art that the present invention is not limited to the number of first hinges 62 that is used. Fewer or more first hinges 62 may be used depending, for example, on the mass of the first and second leafs 14 and 16. Fewer first hinges 62 may be used to support a lighter mass and more first hinges 62 may be used to support a heavier mass.

The door or window assembly 10 is received in an opening for a door or a window. A second hinge 64 is attached to a proximal edge of the third leaf 20 and is arranged to pivotally couple the third leaf 20 to a frame 66 of the door or window. In the embodiment shown, three (3) second hinges 64 are used to couple the third leaf 20 to the frame 66 of the door or window. However, it should be understood by those of ordinary skill in the art that the present invention is not limited to the number of second hinges 64 that is used. Fewer or more second hinges 64 may be used depending, for example, on the mass of the first, second and third leafs 14, 16 and 20. Fewer second hinges 64 may be used to support a lighter mass and a greater number of second hinges 64 may be employed to support a heavier mass.

The first leaf 14 is slidable along the track assembly 12 in a plane of the first leaf 14 between a first position in which the first leaf 14 is fully extended relative to the second leaf 16 and a second position in which the first leaf 14 is fully retracted relative to the second leaf 16. The first leaf 14 is shown in the first position in FIGS. 1 to 9 and in the second position in FIGS. 10 to 16.

In the embodiment shown, the locking mechanism 18 includes a latch member 68 having an inclined surface 70. The latch member 68 is arranged to be retracted when the inclined surface 70 is depressed.

The first, second and third leafs 14, 16 and 20 in the present embodiment are suspended from the track assembly 12 and thus make use of only the track assembly 12 overhead to guide the movement of the first, second and third leafs 14, 16 and 20. Advantageously, this does away with the need to provide a guide rail or track on the floor or a windowsill. With no bottom track or guide rail, issues with dust collecting in the track and track deformation and the risk of a person tripping over the track or guide rail provided on the floor are eliminated. Although the door or window assembly 10 of the present embodiment is shown as being top-hung, it should be understood by those of ordinary skill in the art that the present invention is not limited to being top-hung. A bottom track may be provided in an alternative embodiment where, for instance, strong winds are expected or to prevent seepage of water at a bottom edge of the door or window opening.

Referring now to FIGS. 2 to 6, the track assembly 12 includes a first upper track 72, a second upper track 74 and a lower track 76. Separately, a first track 78 is provided or formed on a top rail 28 of the first leaf 14 and a second track 80 is provided or formed on a top rail 30 of the second leaf 16.

As can be seen from FIG. 1, the first and second upper tracks 72 and 74 in the embodiment shown extend across a width of the door or window assembly 10 and the lower track 76 extends across a portion of the width of the first leaf 14.

Referring again to FIGS. 2 to 6, the first upper track 72 is arranged to receive the first rotatable roller 52 coupled to the top rail 28 of the first leaf 14, the second upper track 74 is arranged to receive the second rotatable roller 58 coupled to the top rail 30 of the second leaf 16, and the lower track 76 is arranged to receive the first roller 54 coupled to the top rail 28 of the first leaf 14. The third roller 60 coupled to the top rail 30 of the second leaf 16 is arranged to be slidably received in the first track 78 provided or formed on the top rail 28 of the first leaf 14. The second track 80 is arranged to receive the second roller 56 coupled to the top rail 28 of the first leaf 14.

The door or window assembly 10 is operable via an upper and a lower track arrangement. The upper track arrangement includes the first and second upper tracks 72 and 74 of the track assembly 12 and the lower track arrangement includes the lower track 76 of the track assembly 12, the first track 78 provided or formed on the top rail 28 of the first leaf 14 and the second track 80 provided or formed on the top rail 30 of the second leaf 16. Sliding movement of the first leaf 14 is enabled with the lower track arrangement and folding movement of the second and third leafs 16 and 20 is enabled with the upper track arrangement. The third roller 60 helps support and facilitates the sliding motion of the first leaf 14 along the track assembly 12.

In the embodiment shown, the first rotatable roller 52 and the first roller 54 are coupled to the top rail 28 of the first leaf 14 nearer the distal edge of the first leaf 14 and the second roller 56 is coupled to the top rail 28 of the first leaf 14 nearer the proximal edge of the first leaf 14.

Figures 2, 3, 4, 5, 6:
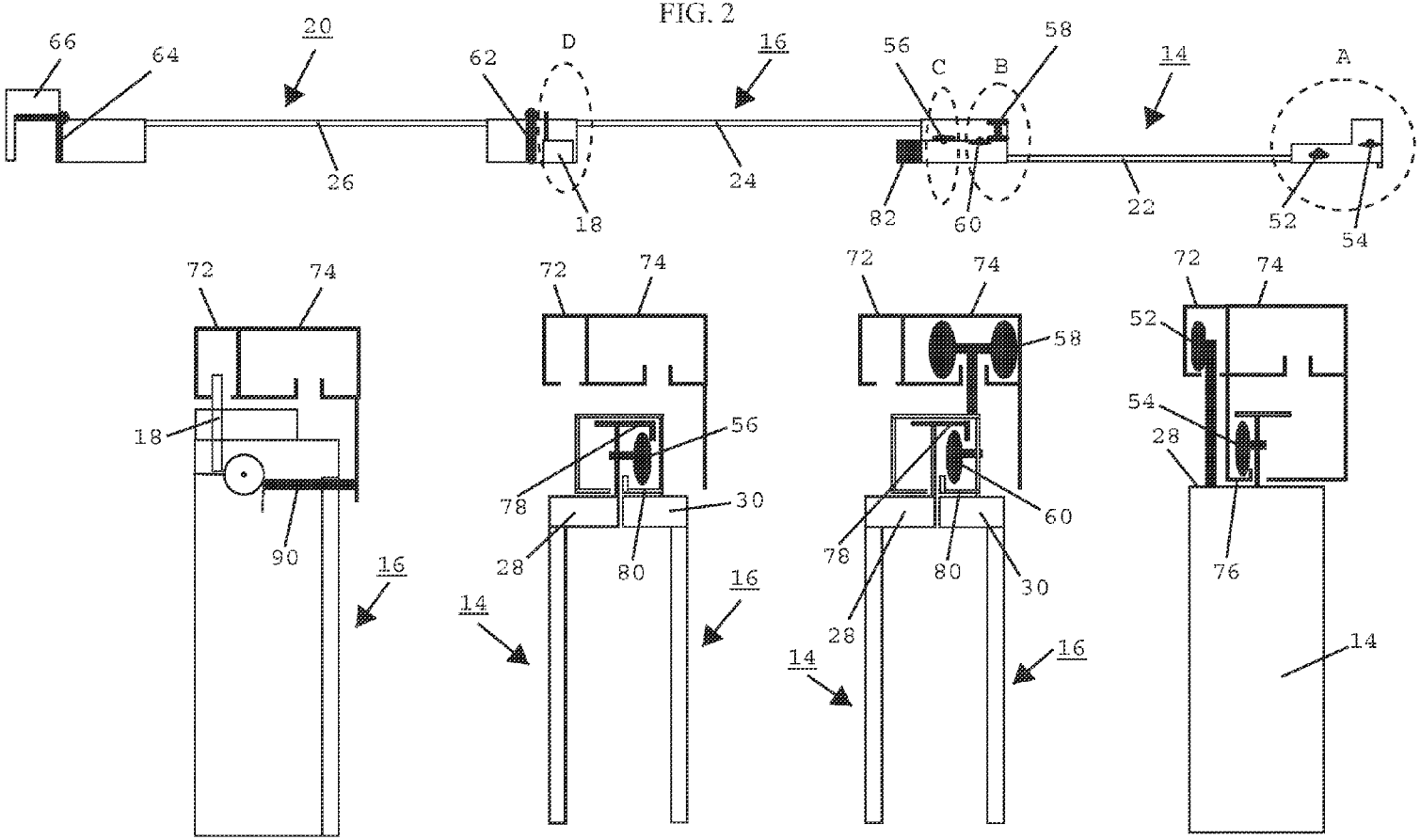
FIG. 2 is a schematic top plan view of the door or window assembly of FIG. 1.
FIG. 3 is an enlarged schematic sectional view of portion A of FIG. 2.
FIG. 4 is an enlarged schematic sectional view of portion B of FIG. 2.
FIG. 5 is an enlarged schematic sectional view of portion C of FIG. 2.
FIG. 6 is an enlarged schematic sectional view of portion D of FIG. 2.

As shown in FIG. 2, the panel 22 of the first leaf 14 is provided in a plane parallel to and set off by a predetermined spacing from the panel 24 of the second leaf 16. The panel 22 of the first leaf 14 is set off-center towards a first side and the panel 24 of the second leaf 16 is set off-center towards a second side. Advantageously, such an arrangement of the panels 22 and 24 will result in a combined leaf having a width equivalent to that of a single conventional leaf, thus providing space savings.

In the embodiment shown, the locking mechanism 18 is provided at a side of the second leaf 16 nearer the third leaf 20. When the first leaf 14 is in the first position, the first and second leafs 14 and 16 do not fully overlap and the locking mechanism remains engaged. In the present embodiment, an actuating member 82 is mounted to the first leaf 14 and is arranged to release the locking mechanism 18 when the first leaf 14 engages the second leaf 16.

Figure 7:
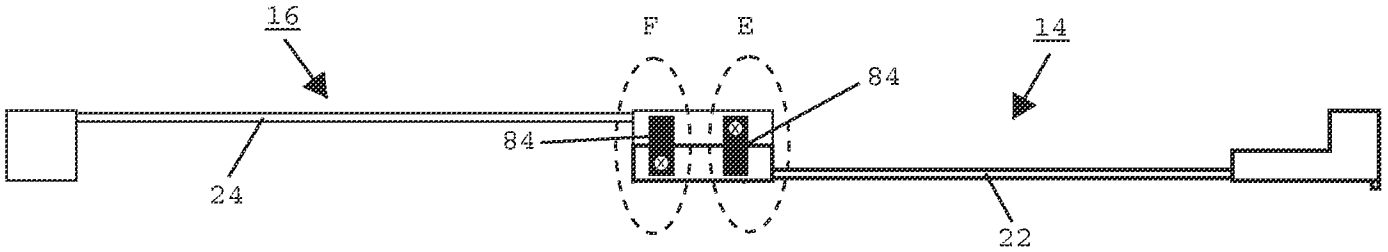
FIG. 7 is a schematic bottom plan view of a first leaf and a second leaf of the door or window assembly of FIG. 1.
Figure 8:
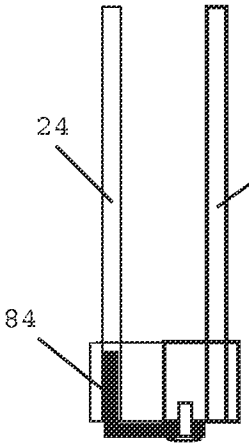
FIG. 8 is an enlarged schematic sectional view of portion E of FIG. 7.
Figure 9:
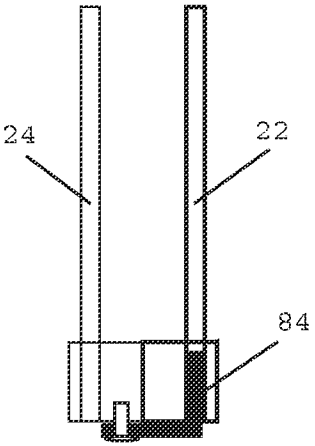
FIG. 9 is an enlarged schematic sectional view of portion F of FIG. 7.

Referring now to FIGS. 7 to 9, a retaining member 84 couples a base portion of the first leaf 14 to a base portion of the second leaf 16 in the embodiment shown. Advantageously, the provision of the retaining member 84 helps to keep the first and second leafs 14 and 16 in alignment during the sliding movement and does away with the need to provide a guide rail or track on the floor or windowsill. With no bottom track or guide rail, issues with dust collecting in the track and track deformation and the risk of a person tripping over the track or guide rail provided on the floor are eliminated. In the embodiment shown, the retaining member 84 comprises a pair of inner panel hooks.

Having described the various components of the door or window assembly 10, the operation of the door or window assembly 10 will now be described below with reference to FIGS. 10 to 19.

The operation to retract the door or window assembly 10 begins by sliding the first leaf 14 from the first position into engagement with the second leaf 16 at the second position.

Referring now to FIGS. 10 to 19, the door or window assembly 10 with the first leaf 14 in the second position is shown. The first leaf 14 slides into engagement with the second leaf 16 using the first and second rollers 54 and 56 coupled to the first leaf 14 and the third roller 60 coupled to the second leaf 16. The sliding motion of the first leaf 14 is guided and aided by the first and second rollers 54 and 56 coupled to the first leaf 14 and the third roller 60 coupled to the second leaf 16. The first leaf 14 is arranged to engage the second leaf 16 to form a combined leaf 86 when the first leaf 14 is in the second position. In the embodiment shown, the first leaf 14 latches onto the second leaf 16 when in the second position to form the combined leaf 86. The combined leaf 86 is arranged to be foldable against the third leaf 20.

In the embodiment shown, the first stile 40 of the first leaf 14 is arranged to abut the first stile 42 of the second leaf 16 and the second stile 46 of the first leaf 14 is arranged to abut the second stile 48 of the second leaf 16 when the first leaf 14 is in the second position.

The locking mechanism 18 is released when the first leaf 14 engages the second leaf 16 in the second position. In the embodiment shown, the actuating member 82 mounted to the first leaf 14 engages the inclined surface 70 of the latch member 68 when the first leaf 14 slides into the second position and in so doing depresses the inclined surface 70 and causes the latch member 68 to retract, thereby disengaging the locking mechanism 18.

In the present embodiment, a biasing element 88 is provided. The biasing element 88 is operable to bias the combined leaf 86 and the third leaf 20 into a folded position when the locking mechanism 18 is disengaged from the track assembly 12. In the embodiment shown, the biasing element 88 includes a spring-biased actuator 90 coupled to the locking mechanism 18. The spring-biased actuator 90 is arranged to push the combined leaf 86 away from the track assembly 12 when the locking mechanism 18 is disengaged from the track assembly 12. In the embodiment shown in FIG. 15, when the latch member 68 of the locking mechanism 18 is retracted, the latch member 68 pushes the spring-biased actuator 90 outwards and the spring-biased actuator 90 in turn pushes the hinged joint between the combined leaf 86 and the third leaf 20 away from the track assembly 12, causing the door or window assembly 10 to fold. Accordingly, once the locking mechanism 18 is disengaged, the folding mechanism is automatically triggered. Thus, following the initial sliding motion, the combined leaf 86 proceeds to fold against the third leaf 20. Advantageously, this allows the opening in which the door or window assembly 10 is received in to be fully opened up by a user with a single sliding motion.

Figure 13:
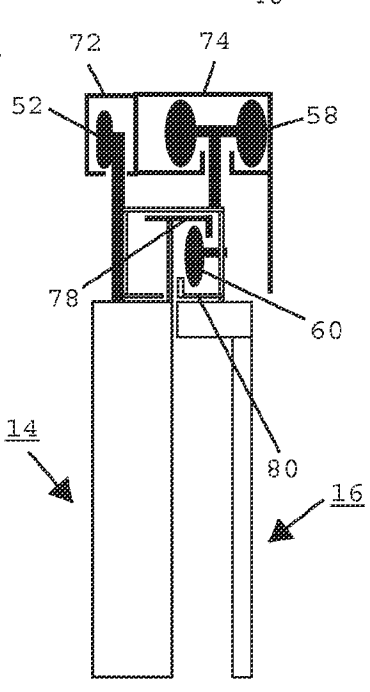
FIG. 13 is an enlarged schematic sectional view of portion H of FIG. 11.
Figure 14:
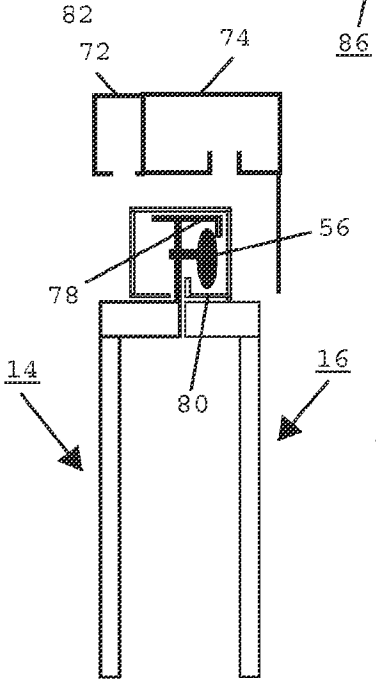
FIG. 14 is an enlarged schematic sectional view of portion I of FIG. 11.
Figure 15:
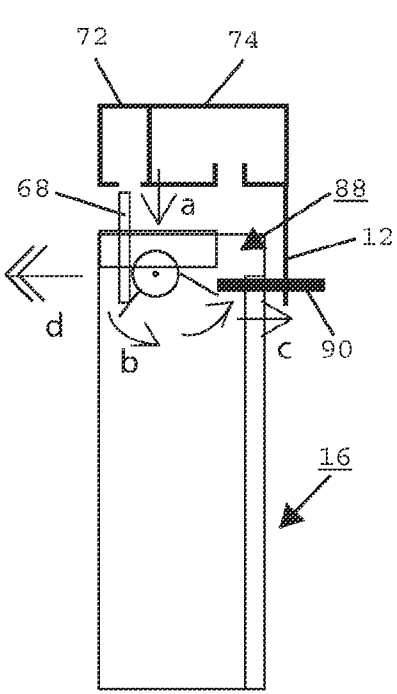
FIG. 15 is an enlarged schematic sectional view of portion J of FIG. 11.

As shown in FIG. 13, the first and second rotatable rollers 52 and 58 are aligned when the first leaf 14 is in the second position. Advantageously, this facilitates the subsequent folding of the combined leaf 86 against the third leaf 20.

Figure 10:
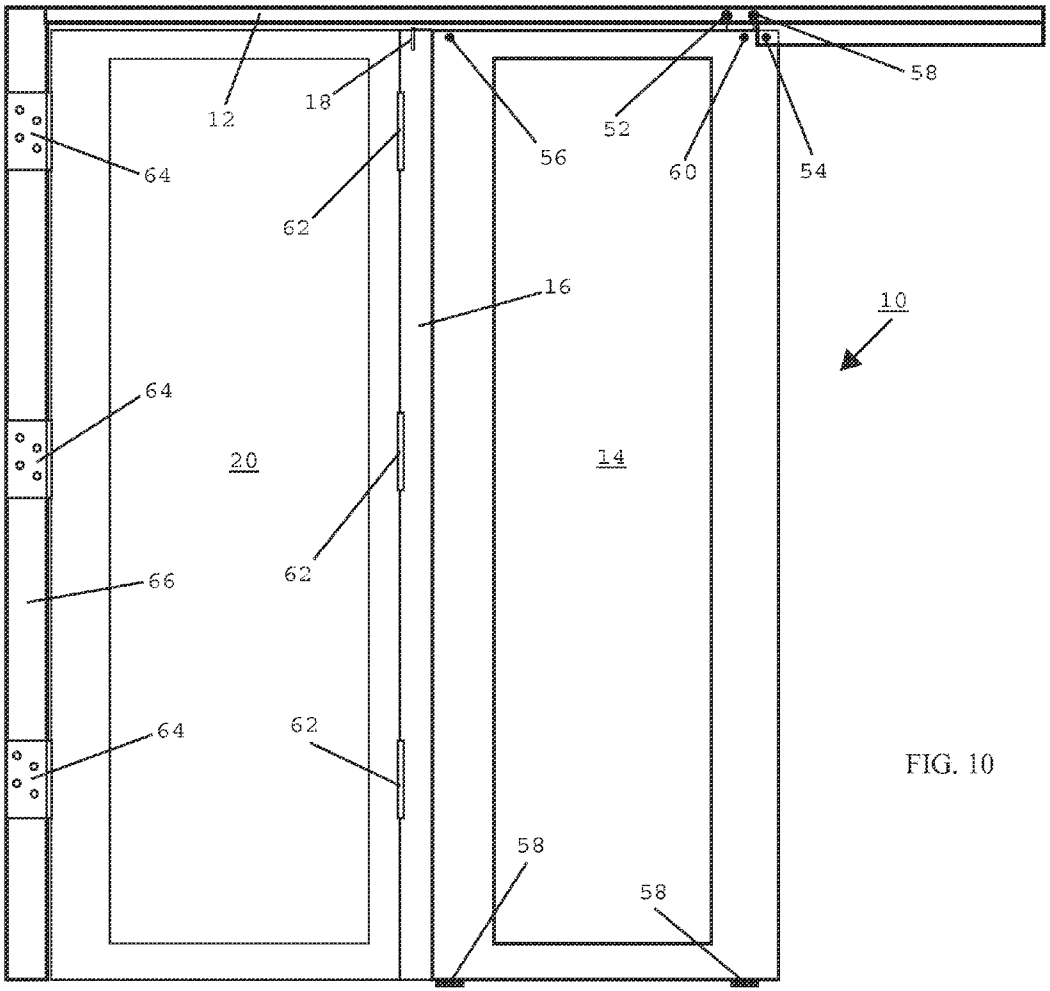
FIG. 10 is a schematic view of the door or window assembly when the first leaf is in a retracted position in accordance with an embodiment of the present invention.
Figure 11:
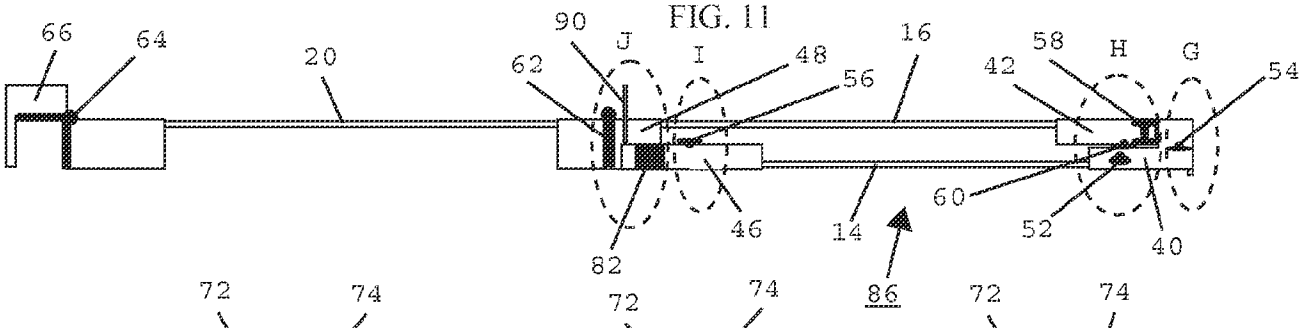
FIG. 11 is a schematic top plan view of the door or window assembly of FIG. 10.
Figure 12:
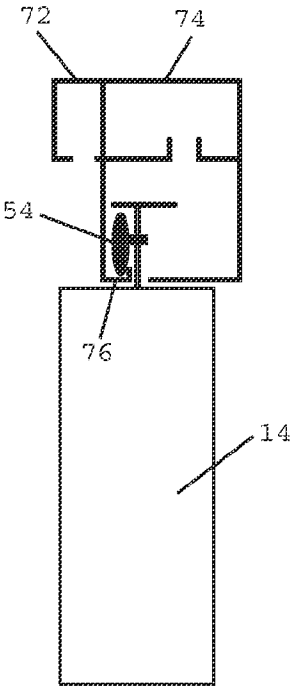
FIG. 12 is an enlarged schematic sectional view of portion G of FIG. 11.
Figure 16:
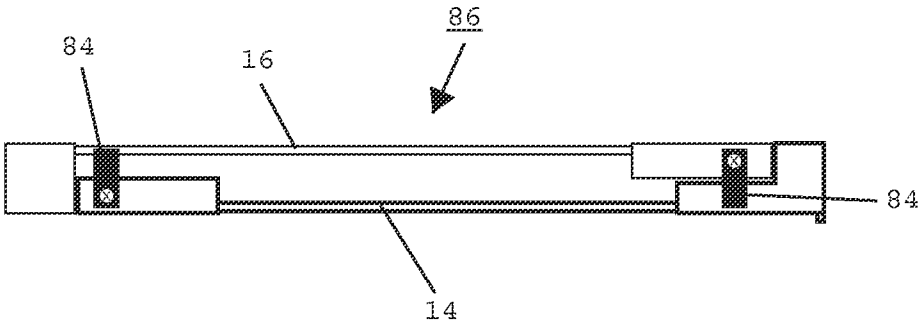
FIG. 16 is a schematic bottom plan view of the first and second leafs of the door or window assembly of FIG. 10.

Referring now to FIG. 16, a schematic bottom plan view of the first leaf 14 and the second leaf 16 of the door or window assembly 10 of FIG. 10 is shown. As can be seen from FIG. 16, the retaining member 84 couples the base portion of the first leaf 14 to the base portion of the second leaf 16, keeping the first and second leafs 14 and 16 from separating and in alignment during the sliding movement.

Figure 17:
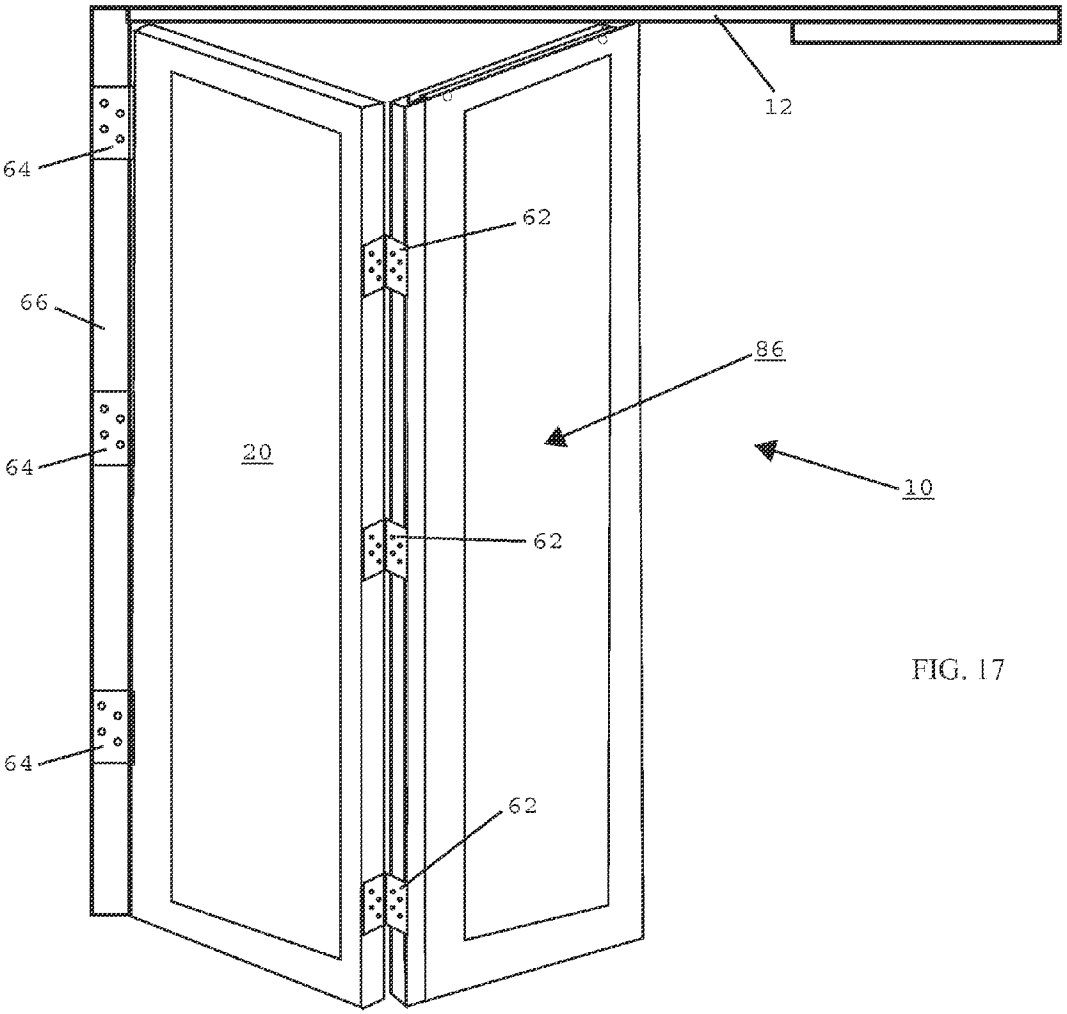
FIG. 17 is a schematic view of the door or window assembly in a partially folded state in accordance with an embodiment of the present invention.
Figure 18:
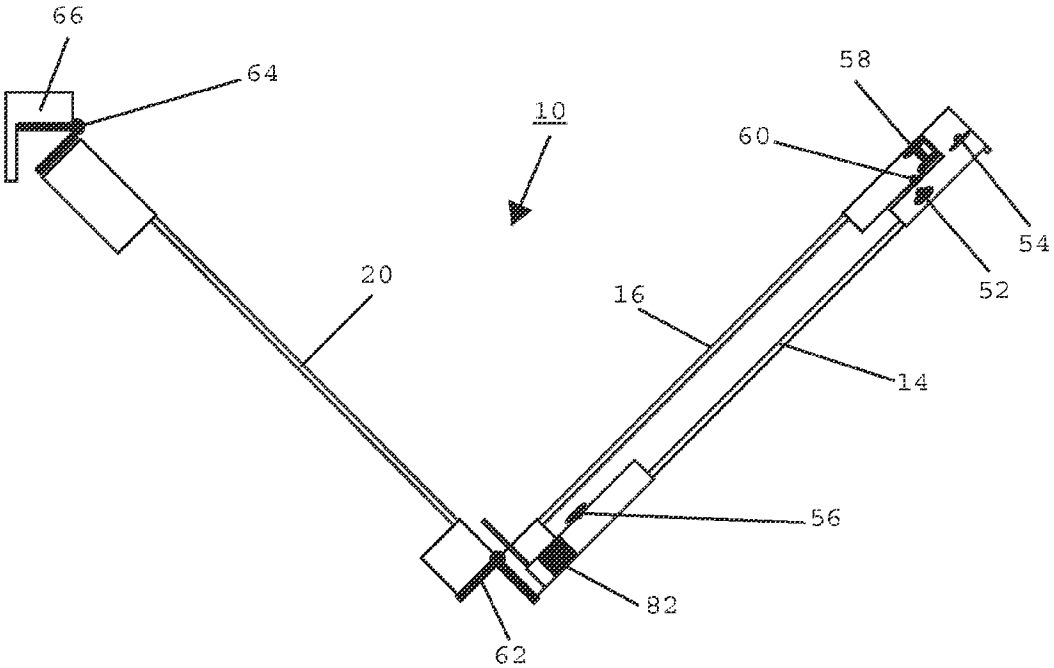
FIG. 18 is a schematic top plan view of the door or window assembly of FIG. 17.

Referring now to FIGS. 17 and 18, the door assembly 10 is shown in a partially folded state. The folding motion is enabled by the first hinge 62 coupling the second and third leafs 16 and 20 and the second hinge 64 coupling the third leaf 20 to the frame 66.

The first rotatable roller 52 coupled to the first leaf 14 and the second rotatable roller 58 coupled to the second leaf 16 serve to guide the movement of the third leaf 20 and the combined leaf 86 as they fold, keeping the third leaf 20 and the combined leaf 86 aligned with the track assembly 12. Apart from supporting the weight and facilitating the sliding motion of the first leaf 14, the first rotatable roller 52 also helps prevent disengagement of the first leaf 14 from the second leaf 16 during the folding process.

Figure 19:
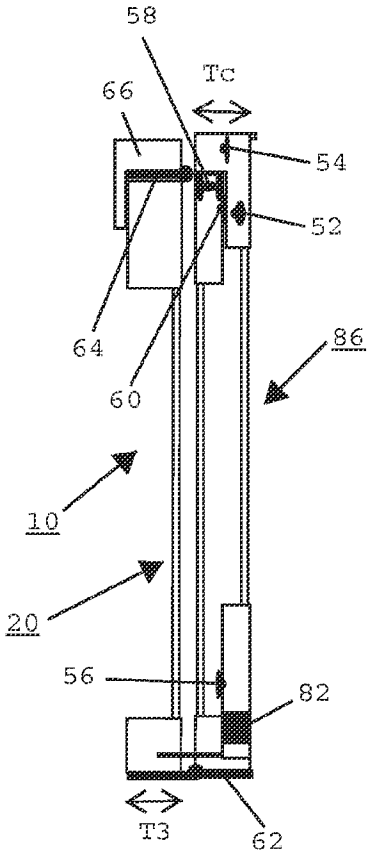
FIG. 19 is a schematic top plan view of the door or window assembly in a fully folded state in accordance with an embodiment of the present invention.

Referring now to FIG. 19, a schematic top plan view of the door or window assembly 10 in a fully folded state is shown. As shown in FIG. 19, a thickness $T_c$ of the combined leaf 86 is the same as a thickness $T_3$ of the third leaf 20. Thus, although the door or window assembly 10 is made up of three (3) leafs, the combined stack width at the side is only equivalent to that of two (2) leafs, and not three (3). Advantageously, this reduces the stacking width space requirements at the sides and provides more room for passage through the opening when the door or window assembly 10 is folded. Furthermore, as can be seen from FIG. 19, the second hinge 64 is mounted on the proximal edge of the third leaf 20 such that the second hinge 64 is in a closed position and the proximal edge of the third leaf 20 abuts the frame 66 when the combined leaf 86 is folded against the third leaf 20. That is, when the door or window assembly 10 is folded and the door or window opening is open, the second hinges 64 are in the closed position with the folded door or window assembly 10 leaning against the frame 66. Advantageously, the arrangement of the folded door or window assembly 10 abutting the frame 66 at the proximal edge provides additional support to the door or window assembly 10 and helps prevent the door or window assembly 10 from sagging, becoming misaligned or coming unhinged from the frame 66 over time. This is because when the door or window assembly 10 is folded, the weight of the door or window assembly 10, which would otherwise be supported only by the second hinges 64, is being distributed to the frame 66 as well.

Conversely, when the door or window assembly 10 is opened up and fully extended as shown in FIGS, 1 and 2, the door or window opening is closed and the second hinges 64 are in an open position. In this situation, the weight of the door or window assembly 10 is distributed amongst the rollers 52, 54, 56, 58 and 60 and the first hinges 62 as well. The distribution of the weight of the door or window assembly 10 across the various components helps reduce the risk of sagging and misalignment of the door or window assembly 10 over time.

As is evident from the foregoing discussion, the present invention provides a door or window assembly that can be fully opened up by a single sliding movement. Both the sliding and folding mechanisms of the door or window assembly are triggered by the single sliding movement. The motion of sliding the first leaf of the door or window assembly into engagement with the second leaf continues on to fold the combined leaf against the third leaf. The door or window assembly of the present invention is thus easily operable and intuitive to use. The door or window assembly of the present invention is also fully openable and takes up a small footprint with reduced stacking width space requirements at the sides, providing more room for passage through an opening when the door or window assembly is folded. This also makes it suitable for use in small openings. Further advantageously, the door or window assembly of the present invention has no free ends. This eliminates problems associated with having free ends such as, for example, having to reach out of an opening in a high-rise building to catch a free end of a window panel in order to close a window and slamming of door and window panels. The engagement of the first and second leafs to form the combined panel also provides a neat storage solution for the multiple panels of the door or window assembly of the present invention.

While a preferred embodiment of the invention has been illustrated and described, it will be clear that the invention is not limited to this embodiment only. Numerous modifications, changes, variations, substitutions and equivalents will be apparent to those skilled in the art without departing from the scope of the invention as described in the claims.

Further, unless the context dearly requires otherwise, throughout the description and the claims, the words "comprise", "comprising" and the like are to be construed in an inclusive as opposed to an exclusive or exhaustive sense; that is to say, in the sense of "including, but not limited to".

The invention claimed is:

1. A door or window assembly, comprising:

a track assembly;

a first leaf slidable along the track assembly in a plane of the first leaf between a first position and a second position;

a second leaf moveably coupled to the track assembly, wherein the first leaf is arranged to engage the second leaf to form a combined leaf when the first leaf is in the second position;

a third leaf pivotally coupled to the second leaf, wherein the combined leaf is arranged to be foldable against the third leaf; and a locking mechanism operable to lock the second leaf in a stationary position relative to the track assembly, wherein the locking mechanism is released when the first leaf engages the second leaf in the second position.

2. The door or window assembly of claim 1, wherein the locking mechanism comprises a latch member having an inclined surface, wherein the latch member is arranged to be retracted when the inclined surface is depressed.

3. The door or window assembly of claim 1, further comprising an actuating member mounted to the first leaf and arranged to release the locking mechanism when the first leaf engages the second leaf.

4. The door or window assembly of claim 1, further comprising a biasing element operable to bias the combined leaf and the third leaf into a folded position when the locking mechanism is disengaged from the track assembly.

5. The door or window assembly of claim 4, wherein the biasing element comprises a spring-biased actuator coupled to the locking mechanism, wherein the spring-biased actuator is arranged to push the combined leaf away from the track assembly when the locking mechanism is disengaged from the track assembly.

6. The door or window assembly of claim 1, further comprising a first track provided or formed on a top rail of the first leaf and a first rotatable roller, a first roller and a second roller coupled to the top rail of the first leaf.

7. The door or window assembly of claim 6, further comprising a second track provided or formed on a top rail of the second leaf, wherein the second track is arranged to receive the second roller coupled to the top rail of the first leaf.

8. The door or window assembly of claim 7, further comprising a second rotatable roller and a third roller coupled to the top rail of the second leaf, wherein the third roller is arranged to be slidably received in the first track provided or formed on the top rail of the first leaf.

9. The door or window assembly of claim 8, wherein the track assembly comprises a first upper track arranged to receive the first rotatable roller coupled to the top rail of the first leaf, a second upper track arranged to receive the second rotatable roller coupled to the top rail of the second leaf, and a lower track arranged to receive the first roller coupled to the top rail of the first leaf.

10. The door or window assembly of claim 1, wherein a first stile of the first leaf is arranged to abut a first stile of the second leaf and a second stile of the first leaf is arranged to abut a second stile of the second leaf when the first leaf is in the second position.

11. The door or window assembly of claim 1, wherein a panel of the first leaf is provided in a plane parallel to and setoff by a predetermined spacing from a panel of the second leaf.

12. The door or window assembly of claim 1, wherein a thickness of the combined leaf is the same as a thickness of the third leaf.

13. The door or window assembly of claim 1, further comprising a first hinge pivotally coupling the second leaf to the third leaf.

14. The door or window assembly of claim 13, further comprising a second hinge attached to a proximal edge of the third leaf, wherein the second hinge is arranged to pivotally couple the third leaf to a frame and wherein the second hinge is mounted such that the second hinge is in a closed position when the combined leaf is folded against the third leaf.

15. The door or window assembly of claim 1, wherein the first, second and third leafs are suspended from the track assembly.

16. The door assembly of claim 1, further comprising a retaining member coupling a base portion of the first leaf to a base portion of the second leaf.

* * * * *